US005244710A

United States Patent [19]

Bricher et al.

[11] Patent Number: 5,244,710

[45] Date of Patent: Sep. 14, 1993

[54] TABLE PAD SWING LOCK

[75] Inventors: Donald W. Bricher, St. Paul; John C. Walseth, Blaine, both of Minn.

[73] Assignee: Lydon-Bricher Manufacturing Company, St. Paul, Minn.

[21] Appl. No.: 887,328

[22] Filed: May 22, 1992

[51] Int. Cl.[5] ..... B32B 3/06

[52] U.S. Cl. ..... 428/100; 428/58; 428/192; 248/346; 292/111

[58] Field of Search ..... 428/58, 100; 248/346; 292/111

[56] References Cited

U.S. PATENT DOCUMENTS

| | | | |
|---|---|---|---|
| 888,113 | 5/1908 | McKay | 160/231 R |
| 1,214,054 | 1/1917 | Mendenhall | 160/231 R |
| 1,595,899 | 8/1926 | McDonough | 160/231 R |
| 1,712,320 | 5/1929 | Zitzerman | 52/127 |
| 1,712,373 | 5/1929 | Winter | 160/231 R |
| 1,852,323 | 4/1932 | Long | 160/231 R |
| 1,889,355 | 11/1932 | Greenhill | 52/127 |
| 2,167,195 | 7/1939 | Ash | 45/68.4 |
| 2,581,816 | 1/1952 | Schlueter | 70/57 |
| 2,595,111 | 4/1952 | Steward | 154/49 |
| 2,670,567 | 3/1954 | Meyer | 45/68.4 |
| 3,661,410 | 5/1972 | Larson et al. | 287/20 |
| 4,020,613 | 5/1977 | Reynolds et al. | 52/321 |
| 4,235,053 | 11/1980 | Rosen | 52/127 |
| 4,517,232 | 5/1985 | Krauser | 428/57 |

*Primary Examiner*—Alexander S. Thomas
*Attorney, Agent, or Firm*—Merchant, Gould, Smith, Edell, Welter & Schmidt

[57] ABSTRACT

Disclosed a lock apparatus (14) for a table pad (10). The lock apparatus (14) has a swing lock member (15) which rotates about a pin (31) extending through the swing lock's aperture (20). A lock housing (16) has upper and lower sheets (25, 26), between which is mounted the swing lock member (15). A post housing (17) is positioned at the adjacent table pad's corner section and provides a post (18) about which the swing lock (15) engages. A method for manufacturing a lock apparatus (14) for a table pad (10) is also disclosed.

5 Claims, 4 Drawing Sheets

TABLE PAD SWING LOCK

FIELD OF THE INVENTION

This invention relates generally to table pads, and more particularly to a locking assembly which is used in connecting adjacent sections of table pads.

BACKGROUND OF THE INVENTION

Protective pads are often used to protect highly finished and polished surfaces such as tables. Protective pads are utilized over these table surfaces to protect them from scratches, mars, burns and other similar damage to the surfaces when the table is in use. Such pads are heatresistant and waterproof, and the surface of the pad in contact with the table is formed of a material which will not harm the table's finish. Such table pads are well-known in the art, and are described, for example, in U.S. Pat. Nos. 2,670,567 (Meyer); 2,167,195 (Ash); 1,595,899 (McDonough); 1,214,054 (Mendenhall); and 1,712,373 (Winter).

The table pads are utilized on tables of different sizes and shapes, and adjacent sections of pads are positioned in an edgewise relationship to form a unitary table pad structure covering the entire surface to be protected. When a plurality of protective pads are used, they are prone to move or slide away from one another when in use. Also, objects that are placed along the outer edges of the table pads may drop to the floor and break when a pad is moved or slid beyond the end of the table.

Various attempts have been made to provide means for connecting adjacent pad sections together. For example, the Steward patent (U.S. Pat. No. 2,595,111) discloses a U-shaped metal connector having legs which are inserted through the pad and bent to be flush with the top of the pad. This connector is not disengagable, is visible to the user, and is potentially detrimental to the table finish.

Other kinds of interlock assemblies have been utilized which employ a slot and flange or tongue and groove interlocking connection. These assemblies are shown, for example, in Ash (U.S. Pat. No. 2,167,195) and Krauser (U.S. Pat. No. 4,517,232). However, these types of interlock assemblies require rather careful, precise alignment of the table pad sections relative to one another. Also, these assemblies allow some longitudinal movement between the pads, rather than forming a truly unitary table pad structure.

The Rosen patent (U.S. Pat. No. 4,234,053) discloses a table pad latch in which a rotatable latching mechanism is engaged with a post. However, the latching mechanism can become disengaged and lost if it is pulled away from its mounting pin. Furthermore, the Rosen design is complex in construction, resulting in high manufacturing costs and necessitating spot welding for formation of certain components of the latch.

The Greenhill patent (U.S. Pat. No. 1,889,355) discloses a mechanism for interconnecting adjacent table pad sections having a hook member which is engagable with a pin. Manipulation of the hook member is accomplished by pulling upon a looped cord. Because the pins of the mechanism must be embedded between the table pad's laminated layers, proper manufacture and positioning of this type of table pad is rather difficult.

An attachment mechanism which is entirely positioned on the outside vertical edge of the pad is shown by the McKay patent (U.S. Pat. No. 888,113), in which a flexible cord or leather strip is insertable within a prong.

The Long patent (U.S. Pat. No. 1,852,323) discloses a table pad which includes two ordinary latches and hooks to join two separate table sections together. The latches and hooks are secured to the bottom of the table pads but do not touch the table because of tapes that are used on the bottom of the pads to maintain a space between the table top and the bottom of the pads.

The Zitzerman patent (U.S. Pat. No. 1,712,320) discloses a furniture covering pad connector wherein the connector is secured in the center sandwich plane of the protective pad and moves in that plane. A rather elaborate connecting mechanism is disclosed.

Latching mechanisms are also known in the prior art for latching panels together in various applications, as shown in U.S. Pat. Nos. 4,020,613 (Reynolds, et al.); 3,661,410 (Larson); and 2,581,816 (Schlueter).

The present invention addresses the problems associated with the above latch mechanisms for protective table pads.

SUMMARY OF THE INVENTION

One aspect of the present invention is a lock apparatus for a table pad, comprising a swing lock with a circular aperture; a folded plate which serves as a housing for the swing lock and having a hub upon which the swing lock rotates; and a folded plate which serves as a housing for the post with which the swing lock engages when adjacent sections of table pad are being attached. In the preferred embodiment, the lock apparatus is made of a thermoplastic material such as nylon. The swing lock apparatus is embedded within the table pad by a suitable adhesive, so as to be invisible during normal use.

Another aspect of the present invention is a table pad comprised of table pad sections which are positioned side-by-side along an abutting edge. Each table pad section has several layers, with one of those layers having a cutout portion which accommodates the swing lock mechanism for attaching the adjacent sections together.

Another aspect of the present invention is a method for manufacturing a table pad lock apparatus. The inventive method includes the steps of: constructing a pair of folded plates; mounting locking mechanism elements in the folded plate assemblies; and securing the plates between layers of a table pad along the table pad sections' abutting edge. Preferably, the plates are formed from an injection molding process, and the plates are secured within the table pad by means of a suitable adhesive.

The present invention is easy to operate, compatible from an aesthetic viewpoint, and designed not to mar the surface of the underlying table. The swing lock is invisible to the user by being embedded within the table pad itself; the only part which is exposed is a small flange which rests against the edge of the table pad. Thus, the swing lock is normally hidden from view, both when the swing lock is in engagement, and also when the table pad sections are removed from the table for storage. Because the swing lock apparatus is embedded within the table pad, there is no potential contact with the table surface which could be detrimental the table's finish.

The swing lock is also advantageous in that it provides an effective means for interconnecting adjacent sections of a table pad, thus preventing slippage of the table pad and damage to the table top. Each swing lock is provided with a notch which engages with a post, so as to securely hold adjacent table pad sections together. The table pad also effectively prevents liquids from passing through the abutting edges of the pad sections.

Yet another advantage of the present invention is that it has relatively few and simple parts. This makes the swing lock relatively simple and inexpensive to manufacture and to install within the table pad. It also provides for simplicity of operation and a reduced likelihood of breakage.

These and other features of the invention will become apparent from the consideration of the following description of the invention and accompanying drawings which form a part of this application.

BRIEF DESCRIPTION OF THE DRAWINGS

The present invention will be more particularly described with respect to the accompanying drawings, wherein like reference numerals indicate like parts.

DETAILED DESCRIPTION OF THE PREFERRED EMBODIMENT

Figure 1:
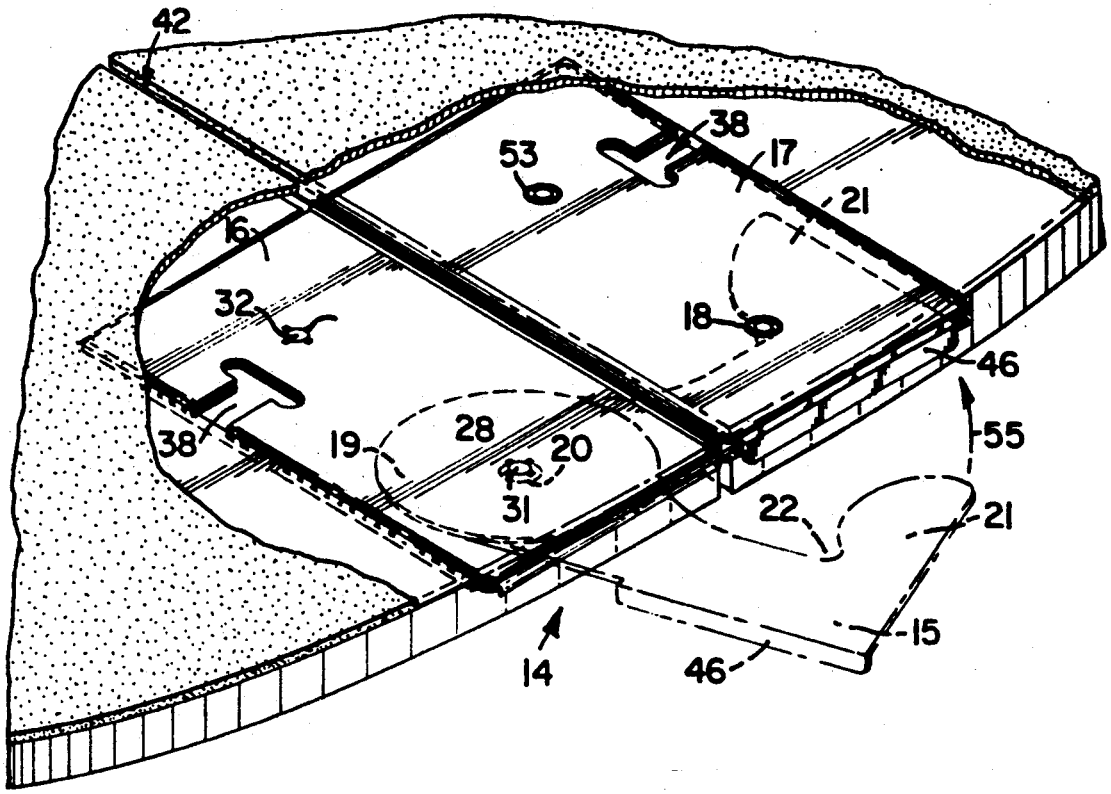
FIG. 1 is a perspective view of the swing lock constructed in accordance with the present invention, illustrating both a disengaged and engaged position.
Figure 2:
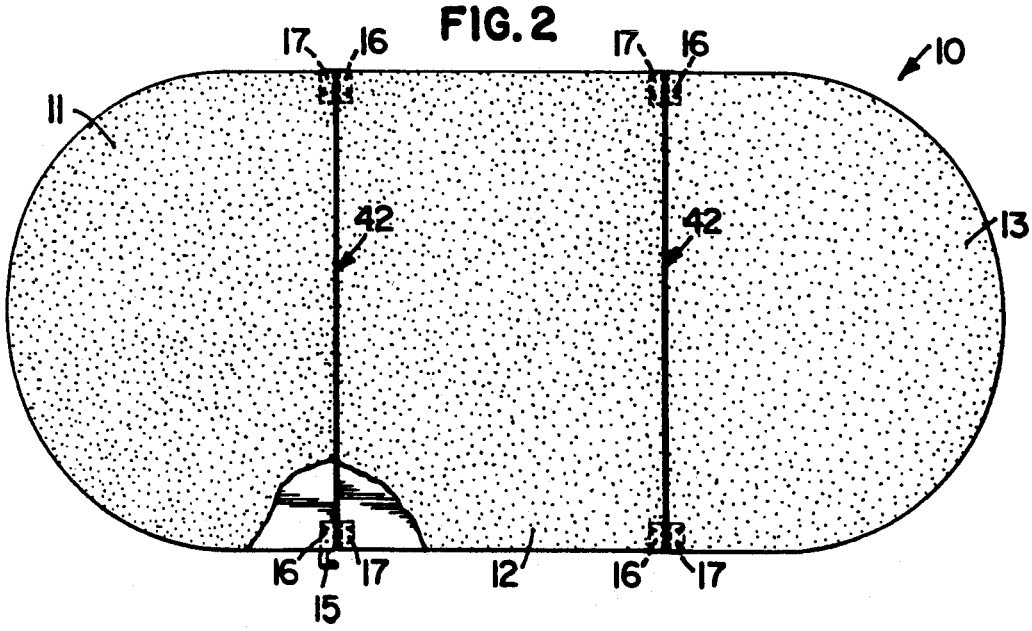
FIG. 2 is a top plan view of a plurality of protective table pads having a swing lock integrated therein and with a portion broken away to illustrate the swing lock.

Referring to the drawings, FIG. 2 illustrates a table pad 10 having three sections 11, 12 and 13 in a side-by-side, abutting relationship along table pad edges 42. FIG. 1 illustrates an enlarged view of the swing lock 14 of the present invention, and FIG. 2 illustrates the positioning of the swing locks 10 in the corner portions of the abutting table pad sections 11, 12, 13. It should be noted that the table pad 10 and swing lock 14 of the present invention may be utilized with a wide variety of table pad sections and shapes joined together in any suitable manner.

Figure 7:
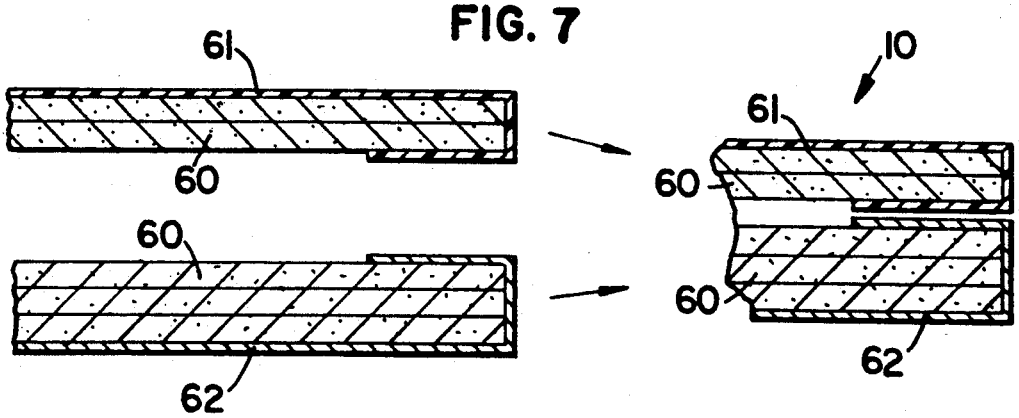
FIG. 7 is a schematic, sectional view illustrating a "tailored" table pad construction.
Figure 8:
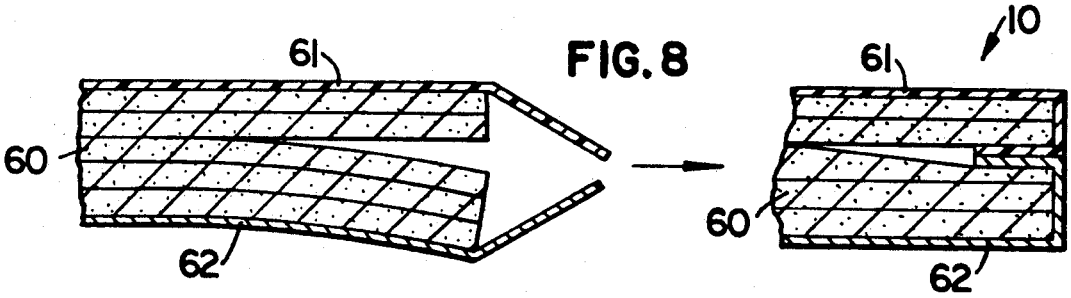
FIG. 8 is a schematic, sectional view of a "tucked" table pad construction.

The table pad sections 11, 12, 13 are made of a plurality of plies of material. Typically, the table pad has three main layers: a central core 60, a top covering 61, and a bottom covering 62. These components are illustrated in the table pad sectional views of FIGS. 7 and 8. The core 60 may be formed of a single, unitary piece (not shown), or it may be formed from a plurality of laminations which are secured together with staples or stitching, as shown in FIGS. 7 and 8. If the core is a unitary piece, it is typically constructed of fiberboard. If laminated, the layers may be made of chip board, cardboard, or felt. The top covering 61 is a waterproof material such as vinyl or oil cloth, and the bottom covering 62 is a soft material such as felt or flannel.

The outer edge portion of the top covering 61 and bottom covering 62 are wrapped around the table pad's sides and adhered between a pair of adjacent core layers along the periphery of the table pad. The coverings 61, 62 are adhered by means of a suitable adhesive. With the "tailored" table pad construction illustrated in FIG. 7, the layers are wrapped around and adhered to a layer (as shown in FIG. 7's drawing on the left), and the pad's laminations are then joined together in a suitable manner (as shown in FIG. 7's drawing on the right). With the "tucked" table pad construction illustrated in FIG. 8, a pair of adjacent core layers are pried apart around the table pad's periphery (as shown in FIG. 8's drawing on the left), and the top and bottom coverings 61, 62 are forced between the layers and secured with adhesive (as shown by FIG. 8's drawing on the right).

Referring to FIG. 1, the locking apparatus 14 has three primary components: a swing lock 15, a lock housing 16, and a post housing 17. The lock housing 16 and post housing 17 are positioned in the corner portion of adjacent table pad sections 11, 12, 13, as shown in FIG. 2. When the table pad 12 is removed, such as when the center leaf of a dining table is removed, the outer sections 11, 13 can be moved together and attached without any modification of the swing lock assembly 14 of the present invention.

As shown in FIG. 1, the swing lock 15 pivots so as to be in engagement with a post means 18 in the post housing 17. Both the disengaged and engaged positions of the swing lock 15 are illustrated in FIG. 1, and rotation of the swing lock 15 is illustrated by the arrow 55. The swing lock 15 has a base portion 19 having a central aperture 20 which accommodates a hub 31 serving as the swing lock's pivot point. The swing lock 15 also has an extension member 21 which hooks around the post 18.

In the preferred embodiment, the inner edge of the extension member 21 has a notch 22. The post 18 is engagable within the notch 22, and the notch 22 is sized and configured to closely match the size and shape of the post 18. The notch 22 substantially wraps around the post 18 so as to prevent inadvertent disengagement of the swing lock apparatus 14. In this manner, the swing lock 15 holds the adjacent table pads sections securely in place.

Figure 3:
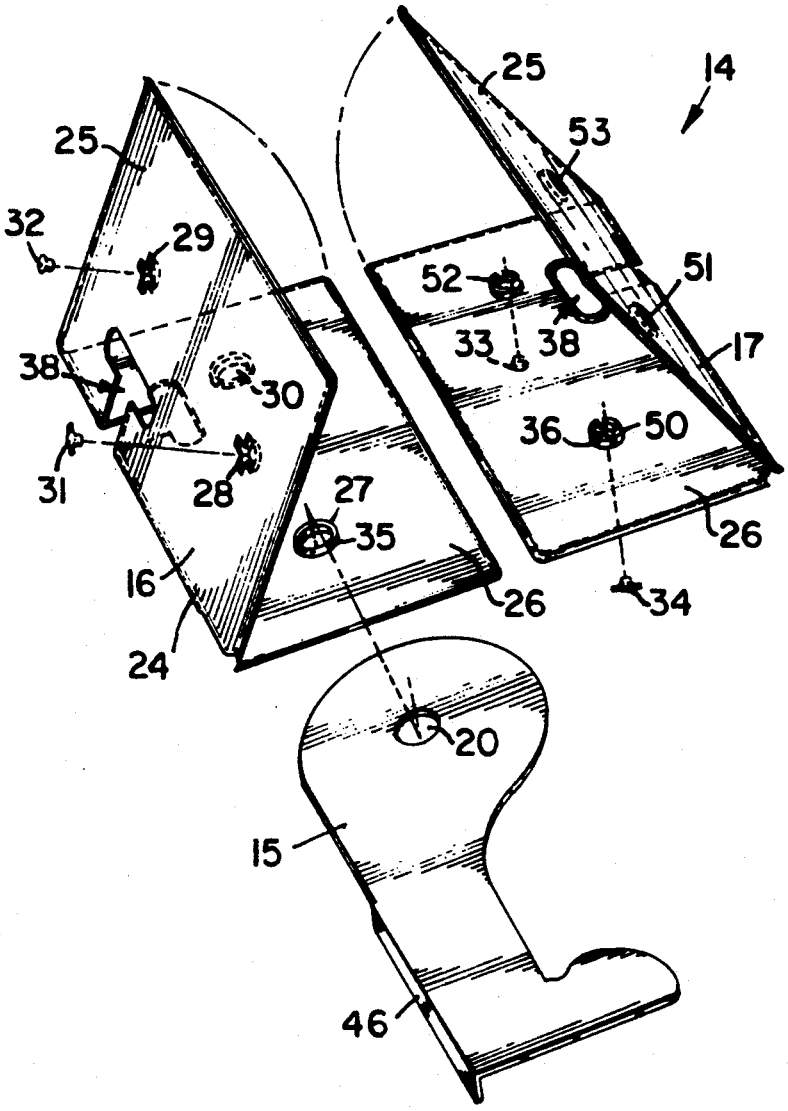
FIG. 3 is a perspective exploded view of the elements of the swing lock.

The lock housing 16 and post housing 17 are of identical construction, and are each formed from a folded plate, as is illustrated more clearly in the exploded view of FIG. 3. The housings or envelopes 16, 17 are each formed from a plate member 23, shown in FIG. 4 in a flat configuration. The lock housing 16 and post housing 17 each have a central, longitudinal fold line 24, and when the plate 23 is folded, the lock housing 16 and post housing 17 each have an upper sheet 25 and lower sheet 26. Each plate 23 has four holes, and when the plate 23 is in its folded configuration, two pairs of aligned holes are formed on each envelope 16, 17. As shown in FIG. 3, holes 27 and 28 on the lock housing 16 and proximate the table's edge are in alignment; holes 29 and 30 on the lock housing 16 and spaced away from the table's edge are in alignment; holes 50, 51 on the post housing 17 and proximate the table's edge are in alignment; and holes 52, 53 on the post housing 17 and spaced away from the table's edge are in alignment.

Each pair of apertures is preferably provided with a pin 31, 32, 33, 34 which is insertable within the corresponding set of holes. That is, pin 31 extends through hole pair 27, 28; pin 32 extends through hole pair 29, 30; pin 33 extends through hole pair 29, 30; and pin 34 extends through hole pair 27, 28.

Figure 4:
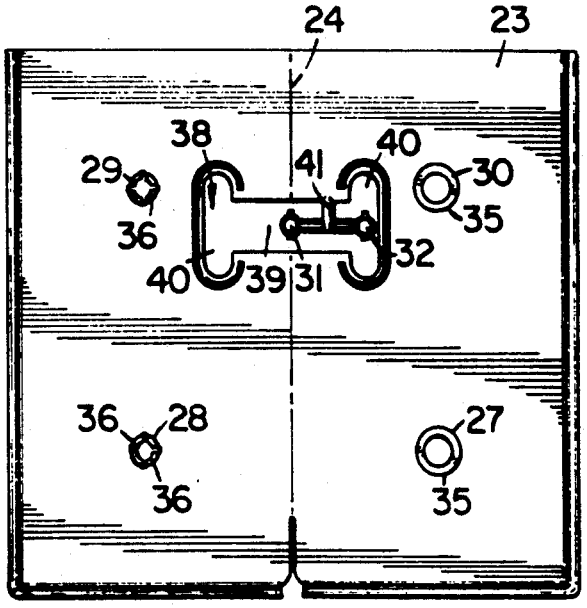
FIG. 4 is a top plan view of one of the swing lock's housings.

The periphery portion of the holes 27, 30, 50, 53 is formed with a raised, annular rim 35 which extends inwardly from the inside surface of the plate 23. The other four holes 28, 29, 50, 52 are formed with a series of four notches 36 about their periphery, the notches 36 extending inwardly from the inside surface of the plate 23. The view illustrated in FIG. 4 shows the inside surface of the lock housing 16 or post housing 17, so as to better illustrate the rim 35 and notches 36. The holes' notches 36 and rim 35 are sized and configured such that when the plate 23 is folded and the respective hole pairs are brought into alignment, each notch 36 snaps into place within the corresponding rim 35. Preferably, the tip portion of each notch 36 is of slightly larger diameter than the base portion of the notch 36, such that the different diameters form a notched ring around each holes 28, 29, 50 and 52. The surface of each notched ring is engagable within the corresponding rim 35.

Figure 9:
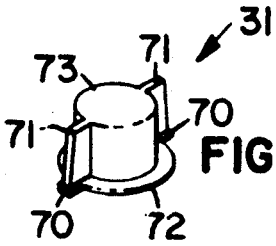
FIG. 9 is a perspective view of a pin utilized with the swing lock.

FIG. 9 is an enlarged view illustrating the preferred construction of pins 31, 32, 33 and 34. Each pin 31, 32, 33 and 34 has a shaft 73 terminating in a head portion of 72 larger diameter at one end. The pin's shaft 73 is slightly smaller than the holes' diameter so that each pin is insertable within the corresponding pair of holes. The head portion 72 has a pair of opposite ears 70 and the shaft has a pair of opposite flanges 71. The ears 70 and notches 71 are in alignment longitudinally. When the pin is inserted into a hole, the ears 70 engage in the apertures between the notches 36 of the holes 28, 29, 50, 52. Thus the pins securely position the housings 16, 17 in their folded configuration. When inserted, the head 72 of the pin is flush with the outer surface of the plate 23, such that the opposite end of the pin is generally flush with the outer surface of the opposite side of the plate 23, as shown in FIG. 1. The pins 31, 32, 33 and 34 are positioned within the corresponding apertures with a friction fit.

As can be seen from FIG. 3, the aperture 20 in the swing lock 15 is positioned to be in alignment with the pair of holes 27, 28, such that the pin 31 extends through the aperture 28, the aperture 20, and the aperture 27. The aperture 20 is approximately the same diameter as the holes 27, 28 and slightly larger than the shaft of the pin 31. In this manner, the pin 31 becomes the hub about which the swing lock 15 rotates. The construction of the pin 31, with its ears 70 and flange 71, allows the pin 31 to be securely locked into place in the lock housing 16. Thus, it is highly unlikely for a user to be able to accidentally remove the swing lock arm 15 from the table pad 10 by disengagement of the pin 31.

The height of the notches 36 is approximately the same as the height of the rim 35, so that the notches 36 are completely engagable within the rim 35. Also, the length of each pin 31, 32, 33, 34 is approximately equal to the height of the rim 35 and notches 36. Each upper and lower sheet 25, 26 thus has a pair of projections (either a pair of notched rings 36 or rims 35) which project inwardly from the inner surface of the plate 23. When constructed, the upper sheet 25 and lower sheet 26 of the lock housing 16 and post housing 17 are in close, parallel relationship, and are spaced apart a distance equal to the height of the rim 35. The rim 35 around pin 34 thus forms the post means 18 which engages with the swing lock's notch 22 when the swing lock 14 is in its engaged position.

The present invention is fabricated from a thermoplastic material by injection molding techniques. In the preferred embodiment, the thermoplastic material from which the swing lock 14 is formed is nylon. Preferably, the inside surface of the plate 23 has a relatively smooth surface, whereas the outer surface of the plate 23 is formed with a roughened texture.

Each plate 23 is formed with a central cutout 38. As illustrated in FIG. 4, the cutout 38 is symmetrical about the central fold line 24. The cutout portion 38 is positioned along an edge of the envelopes 16, 17 which is opposite the seam line 42 between the adjacent table pad sections.

In the preferred embodiment illustrated, the cutout 38 has a central portion 39 which terminates in a pair of oblong portions 40. When the plate 23 comes out of the mold, there is a T-shaped member 41 within the cutout 38, with each end of the "T" terminating in a pin 31, 32, as illustrated in FIG. 4. In this manner, the pins 31, 32, 33, and 34 can be formed in a single molding process along with the plates 23. During the process of assembly, the T-shaped member 41 is broken off from the edge of the cutout 38, and the pins 31, 32 are broken away from the T-shaped portion 41 to be inserted within the appropriate holes. The T-shaped portion 41 is then discarded.

Figure 5:
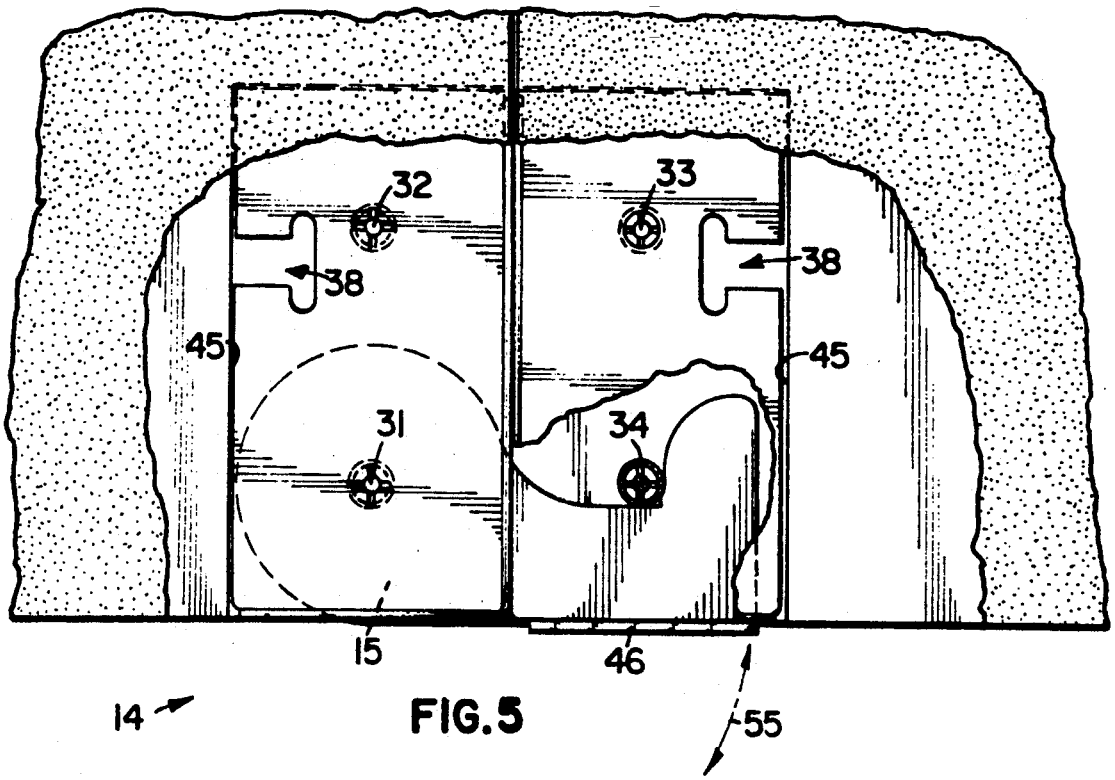
FIG. 5 is a top plan view of the swing lock, in an engaged position, with a portion of the table pad cut away for purposes of illustration.
Figure 6:
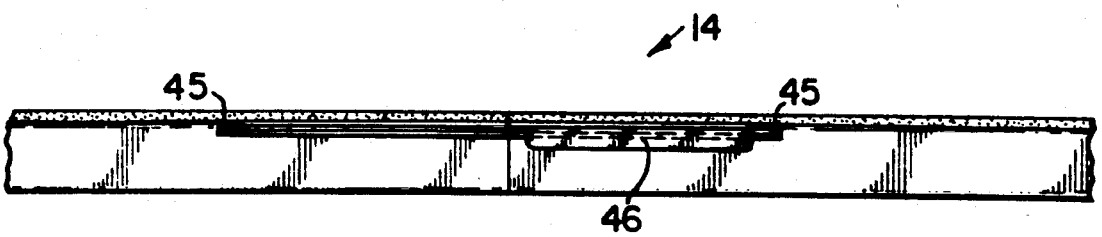
FIG. 6 is a side elevational view of the swing lock illustrated in FIG. 5, in an engaged position.

The assembled housings or envelopes 16, 17 preferably have a thickness that corresponds to the thickness of one of the laminations conventionally used in the table pad 10. In the preferred embodiment, a lamination is cut in a rectangular shape slightly larger than the rectangular dimensions of the envelope 16, 17. Alternatively, if a core-type construction is being employed, a rectangular portion of the fiber board core is cut out to accommodate the thickness of the envelope 16, 17. Such a cutout portion 45 in the interior portion of the table pad is illustrated in FIGS. 5 and 6. The table pad's lamination or core is severed at each internal corner during manufacture of the table pad 10. To mount the envelopes 16, 17 in the table pad 10, a suitable adhesive is applied to the inside surfaces of the top and bottom laminations to cement these laminations to the exterior surfaces of the envelope 16, 17. Preferably, a hot-melt type of adhesive is utilized. The cutout portion or dam 38 forms a well for the adhesive, thereby allowing a more secure attachment. The cutout 38 controls the location of the adhesive such that the adhesive does not enter the working area of the swing lock 10 and does not interfere with its movable parts. In addition, the roughened texture of the sheets' outer surfaces further enhances the bond between the envelope 16, 17 and the table pad 10. In this manner, the swing lock assembly 10 can be installed in a table pad 10 having either a "tailored" or "tucked" construction. This secures the envelope 16, 17 in a fixed relationship with respect to the table pad's internal corner.

When the swing lock or hook 15 is arranged in a latched, engaged position, the flange 46 is flush against the exterior of the latched table pad, as shown in FIG. 6. The flange 46 provides a handle for grasping the swing lock 15 for pivoting it in the desired direction. When the swing lock 15 is placed in an unlatched position exterior of the table pad, relative movement between the pads 11, 12, 13 is permitted.

For storage purposes when the table pads are not being utilized, the swing lock 15 may be stored within the envelope 16 by rotating it counterclockwise from the position illustrated in FIG. 1 so that the notch 22 is proximate the inner aperture 30 in the envelope 16.

It is to be understood that numerous and various modifications can be readily devised in accordance with the principles of the present invention by those skilled in the art without departing from the spirit and scope of the invention. Therefore, it is not desired to restrict the invention to the particular constructions illustrated and described but to cover all modifications that may fall within the scope of the appended claims.

What is claimed is:

1. A table pad, comprising:

(a) a pair of table pad sections, each section including an upper layer and lower layer, said sections having an abutting edge, a corner portion of each section having a cutout portion between said upper and lower layers;

(b) means for attaching said sections together, comprising:

(i) hook means including a base portion and an extension member, said base portion having a circular aperture therein;

(ii) a hook envelope having a fold to form symmetrical upper and lower sheets, said sheets having a pair of aligned holes in which a hub is positioned, said hub passing through the circular aperture of said hook means;

(iii) a pin envelope having a fold to form symmetrical upper and lower sheets, said sheets having a pair of aligned holes which form post means, wherein said hook envelope and said pin envelope are positioned within said table pad cutout portion, wherein said attachment means are retained with said table pad cutout portion by adhesive means, wherein said hook envelope and said pin envelope each have a cutout portion proximate a folded edge.

2. The table pad according to claim 1, wherein said attachment means is made of a plastic material.

3. The table pad according to claim 1, wherein said attachment means are retained within said table pad cutout portion by adhesive means.

4. The table pad according to claim 1, wherein an outer surface of said sheets has a roughened texture.

5. The table pad according to claim 2, wherein said hub and said post means are molded integrally with said hook envelope and said pin envelope respectively.

* * * * *

UNITED STATES PATENT AND TRADEMARK OFFICE

CERTIFICATE OF CORRECTION

PATENT NO. : 5,244,710

DATED : September 14, 1993

INVENTOR(S) : Bricher et al

It is certified that error appears in the above-identified patent and that said Letters Patent is hereby corrected as shown below:

In the Abstract, Line 2, after the word "Disclosed", please insert --is--.

In Column 2, Line 64, after the word "detrimental", please insert --to--.

In Column 5, Line 21, please delete the word "holes" and substitute the word --hole-- therefor.

In Column 5, Line 26, after the numeral "72", please insert --with a--.

In Column 6, Line 34, delete the word "envelope" and substitute the word "envelopes" therefor.

In Column 6, Line 37, delete the word "envelope" and substitute the word "envelopes" therefor.

In Column 6, Line 45, delete the word "envelope" and substitute the word "envelopes" therefor.

In Column 6, Line 53, delete the word "envelope" and substitute the word "envelopes" therefor.

In Column 6, Line 56, delete the word "envelope" and substitute the word "envelopes" therefor.

In Column 8, Line 10, delete the word "with" and substitute the word "within" therefor.

Signed and Sealed this

Twelfth Day of April, 1994

*Attest:*

Bruce Lehman

BRUCE LEHMAN

*Attesting Officer*

*Commissioner of Patents and Trademarks*